US007916879B2

(12) United States Patent
Pedersen

(10) Patent No.: US 7,916,879 B2
(45) Date of Patent: Mar. 29, 2011

(54) ELECTROSTATIC ACOUSTIC TRANSDUCER BASED ON ROLLING CONTACT MICRO ACTUATOR

(75) Inventor: Michael Pedersen, Ashton, MD (US)

(73) Assignee: Novusonic Corporation, Ashton, MD (US)

( * ) Notice: Subject to any disclaimer, the term of this patent is extended or adjusted under 35 U.S.C. 154(b) by 1116 days.

(21) Appl. No.: 11/595,750

(22) Filed: Nov. 13, 2006

(65) Prior Publication Data

US 2007/0140514 A1 Jun. 21, 2007

Related U.S. Application Data

(60) Provisional application No. 60/751,002, filed on Dec. 16, 2005.

(51) Int. Cl.

| | |
|---|---|
| ***H04R 25/00*** | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |

(52) U.S. Cl. ..... 381/175; 381/191; 381/369

(58) Field of Classification Search ..... 381/175
See application file for complete search history.

(56) References Cited

U.S. PATENT DOCUMENTS 6,552,469 B1 4/2003 Pederson et al.

OTHER PUBLICATIONS

Lee, Seung S., et al "Piezoelectric cantilever microphone and microspeaker", Journal of Microelectromechanical Systems, vol. 5, No. 4, Dec. 1996, pp. 238-242.*

Han, Cheol-Hyun et al, "Fabrication of piezoelectric acoustic transducers built on cantilever-like diaphragm", The 14th IEEE International Conference on Micro Electro Mechanical Systems, 2001, MEMS 2001, Jan. 21-25, 2001, pp. 110-113.*

* cited by examiner

*Primary Examiner* — Curtis Kuntz
*Assistant Examiner* — Matthew Eason

(57) ABSTRACT

An acoustic transducer is disclosed, which comprises a micro fabricated, sound generating, or receiving, diaphragm, a conductive leaf cantilever actuator, and a counter electrode. In the acoustic transducer, the electrostatic attraction force between the counter electrode and the leaf cantilever due to an imposed electrical potential is utilized to generate a deflection of the diaphragm attached to said cantilever. In operation, the cantilever collapses on to the counter electrode, causing a significant increase in actuator driving force due to the reduction, and partial elimination, of the air gap in the transducer.

26 Claims, 6 Drawing Sheets

PRIOR ART

ELECTROSTATIC ACOUSTIC TRANSDUCER BASED ON ROLLING CONTACT MICRO ACTUATOR

This application claims priority of U.S. provisional patent application No. 60/751,002 filed Dec. 16, 2005 hereby incorporated by reference.

FIELD OF THE INVENTION

The invention has applications to the field of acoustic components and transducers, and specifically to the field of acoustic sound generating structures based on micro fabrication.

BACKGROUND OF THE INVENTION

The realization of sound generating structures based on micro fabrication, or micro electro mechanical systems (MEMS), technology is particularly desirable as the utilization of the high-volume batch fabrication technology may reduce the device size, and improve the device quality, yield, and performance-to-cost ratio of such devices. The fundamental problem with sound generation, in contrast to sound detection, is that the device must provide a certain air volume displacement to generate a certain sound pressure. If the area of the sound generating structure (i.e. diaphragm) is reduced, to reduce the overall device size, the result is that the structure must have a larger displacement to generate the same sound pressure. A consequence of this is that the force necessary to drive the diaphragm increases. This is not easily combined with the reduction of the actuator size, since smaller actuators in general provide less actuation force. This scaling issue has proven prohibitive for micro scale implementations of established electromagnetic actuation principles, which are common in larger conventional acoustic transducers, since the actuation force needed is beyond the reasonable capability of electromagnets with excessive power consumption as a result.

There are transduction principles that can generate the necessary forces on the micro scale. The problem is that the force must be generated over a relatively large physical travel of the actuator. This generally disqualifies all piezoelectric actuators, since such devices can generate large strains and forces, but with very limited travel. A more promising actuator technology is based on electrostatic attraction forces that are caused by opposing electrical charges built up on conductive surfaces. Since the electrostatic force is inversely proportional to the square of the distance between the conductors, potentially very large forces can be generated if the conductors are in close proximity. In particular, if an actuator is used in which the conductors come into physical contact, only being separated by a solid insulator, the electrostatic force can be increased substantially if the solid insulator has a high relative permittivity and is very thin. An electrostatic transducer based on an electrostatic actuator principle has been disclosed in U.S. Pat. No. 6,552,469 and is shown in cross-section in FIG. 1. This prior art structure involves a micro fabricated cantilever actuator, which is attached to an external membrane with a support brace. The fabrication of such a support brace and membrane would be cumbersome in high-volume manufacturing, and it would be desirable to integrate all structural components to realize a smaller structure.

SUMMARY OF THE INVENTION

It is therefore an object of this invention to realize an acoustic transducer structure with an integrated electrostatic actuator.

It is a further object of this invention to realize such an electrostatic actuator with as few structural materials as possible to minimize the cost of fabrication.

It is a further object of this invention to realize such an electrostatic actuator that can operate at bias voltages below 10V for easy integration in low voltage portable systems.

It is a further object of this invention to realize all necessary components of said acoustic transducer structure in a monolithic structure.

It is yet a further object of this invention to realize such an acoustic transducer structure in which the electrostatic actuator is fabricated as an integral part of, and is permanently attached to, the diaphragm.

DETAILED DESCRIPTION OF THE INVENTION

The invention results from the realization that an electrostatic actuator can be integrated with a sound generating diaphragm in single a micro fabrication process by forming the necessary movable cantilever, or cantilevers, directly on the diaphragm.

Figure 1:
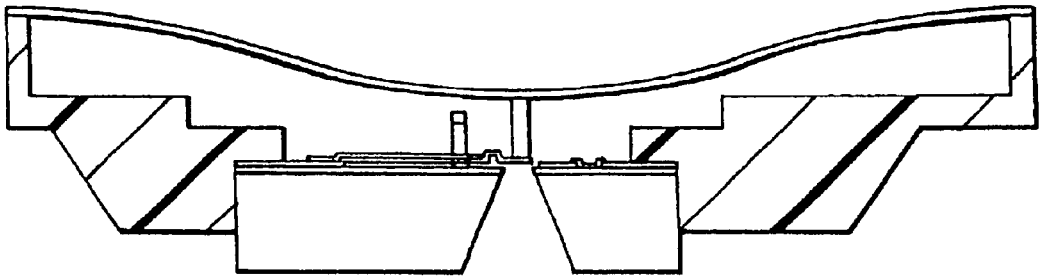
FIG. 1 is a cross-sectional view of a prior art electrostatic acoustic transducer.
Figure 2:
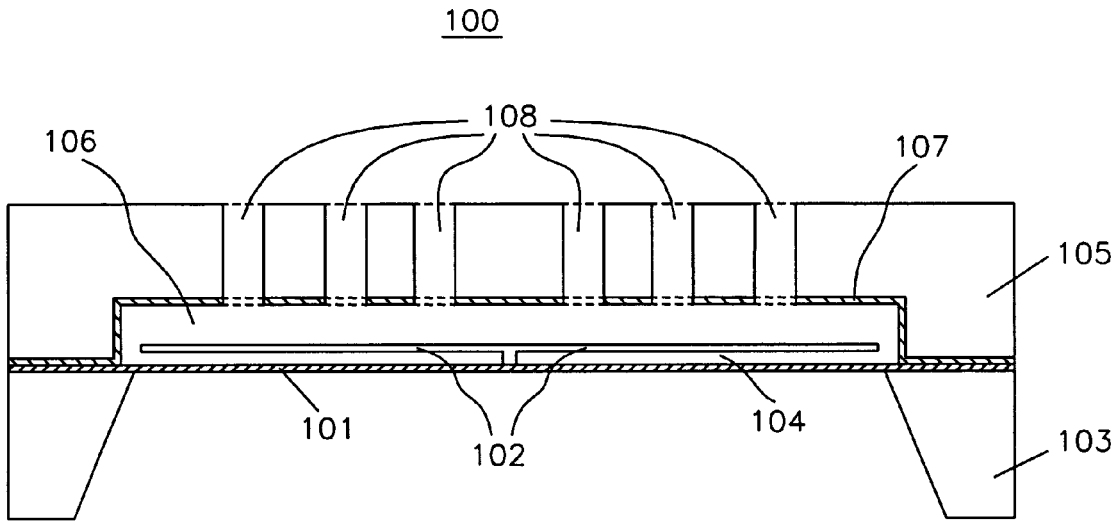
FIG. 2 is a cross-sectional view of an electrostatic acoustic transducer according to the present invention.
Figure 3:
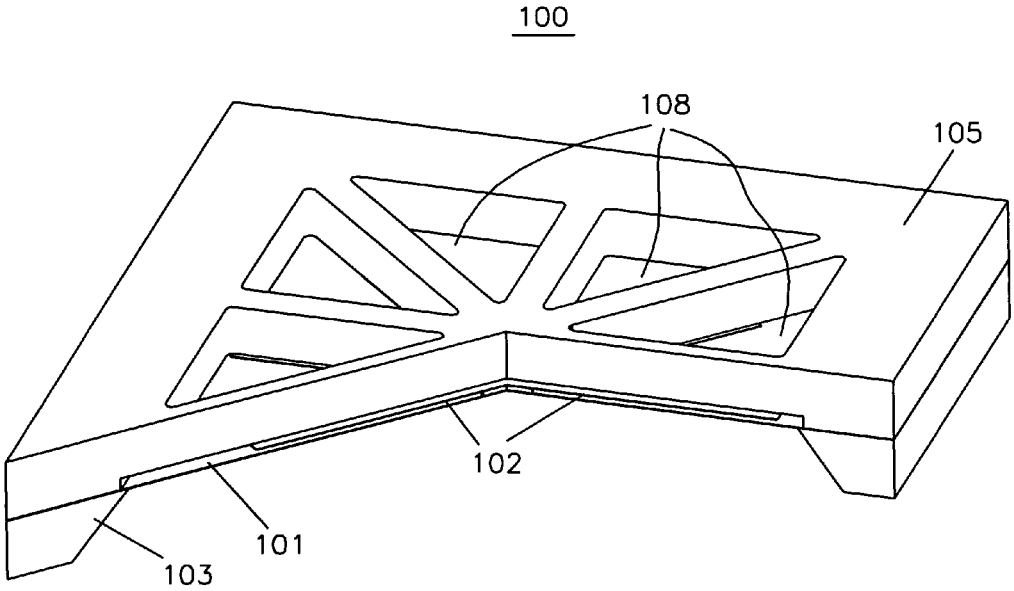
FIG. 3 is a three dimensional cut-away view of an electrostatic transducer according to the present invention.

A preferred embodiment of an acoustic transducer 100 according to the present invention is shown in cross-section in FIG. 2 and in three dimensional cut-away in FIG. 3. In this embodiment, one, or more, cantilevers 102 are formed on the sound generating diaphragm 101, on base substrate 103. Preferred materials for sound generating diaphragm 101 include silicon, polycrystalline silicon, silicon dioxide, silicon nitride, and polymer. A preferred material for base substrate 103 is silicon. Cantilevers 102 are electrically conductive, and may be constructed from a single electrically conductive material, or multiple layers of dielectric and electrically conductive materials, such that the surface of the cantilevers facing cap substrate 105 is electrically conductive. The cantilevers are attached in the center of the diaphragm, the diaphragm being attached along, or at, the perimeter to the base substrate. A small initial air gap 104 is formed by micro fabrication between the cantilevers and diaphragm by a sacrificial layer method. A second cap substrate 105, in which a cavity 106 has been formed, is attached to the base substrate. Preferred methods for the formation of cavity 106 in cap substrate 105 include etching of cap substrate 105 and flow forming by compression stamping of cap substrate 105. The preferred embodiment comprises an insulating cap substrate on which an electrically conductive counter electrode is formed. In a second preferred embodiment the cap substrate is electrically conducting or semi-conducting and therefore directly forms a counter electrode to cantilevers 102. Preferred conductive or semi-conductive materials for cap substrate 105 are silicon, nickel, aluminum, stainless steel, or titanium. The cap substrate is coated with electrical insulator 107, which prevents electrical short circuit during operation of the device. In a second preferred embodiment, electrical insulator 107 is formed on cantilevers 102. Preferred materials for electrical insulator 107 are silicon dioxide, silicon nitride, or a polymer. A number of openings 108 are formed in cap substrate 105 to allow air to flow to and from the cavity 106. Preferred methods for the formation of openings 108 in cap substrate 105 include etching or stamp cutting of cap substrate 105. Preferred methods for the attachment of cap substrate 105 to base substrate 103 include anodic bonding, adhesive bonding, direct bonding, thermo-compression bonding, eutectic bonding, thermo-sonic bonding, microwave bonding, or solder bonding.

Figure 4:
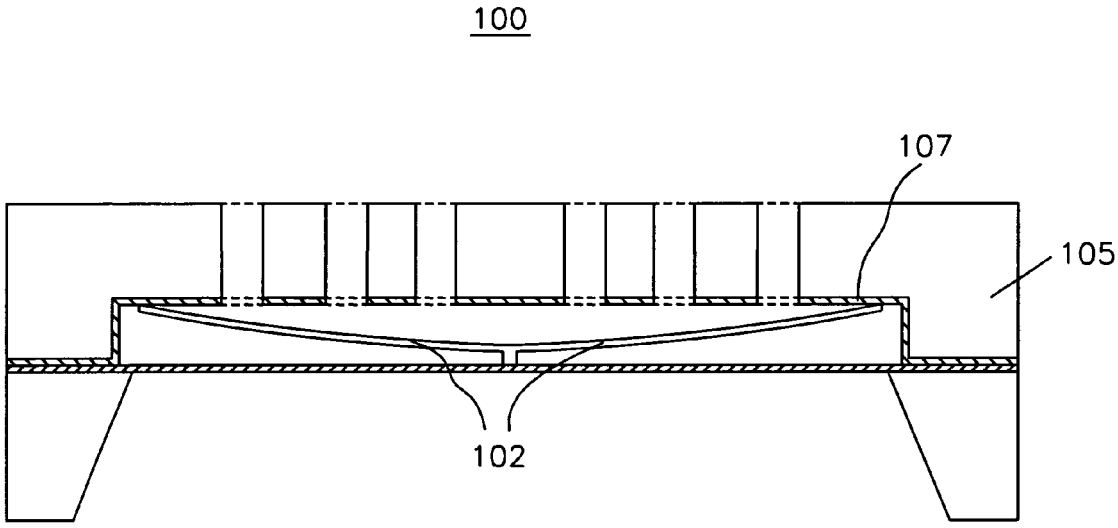
FIG. 4 is a cross-sectional view of an electrostatic acoustic transducer according to the present invention in which an initial electrical potential is applied between the counter electrode and the cantilevers causing the tip of the cantilevers to deflect towards the counter electrode.
Figure 5:
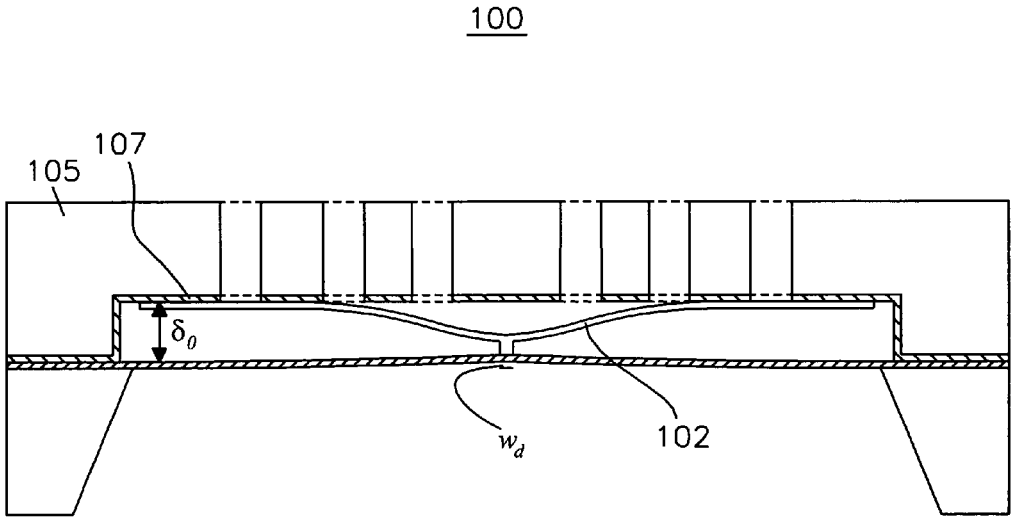
FIG. 5 is a cross-sectional view of an electrostatic acoustic transducer according to the present invention in which an electric potential is applied between the counter electrode and the cantilevers causing the cantilevers to collapse onto the counter electrode, and the diaphragm to deflect towards the counter electrode.

In FIG. 4, the initial operation of the acoustic transducer 100 is shown. An initial electrical potential is applied between the cantilevers 102 and the cap substrate 105. The resulting electrostatic attraction force causes the cantilevers to deflect towards the cap substrate. If the applied electrical potential is large enough, the cantilevers will deflect so far that the tips of the cantilevers will make initial contact with the insulator layer 107 on the cap substrate. Since the electrostatic force is inversely proportional to the conductor separation and proportional to the dielectric constant of the material between the conductors, the cantilevers will quickly collapse on to the cap substrate, as shown in FIG. 5, until a balance is reached between the electrostatic attraction forces and the mechanical restoring forces of the cantilevers and the diaphragm. The nature of the force balance can be analyzed by considering the relaxation of the total stored energy in the acoustic transducer from the diaphragm and cantilever restoring forces, and the electrostatic attraction force. The principle of energy relaxation dictates that the equilibrium of a system is a state in which the stored energy is minimized. The energy consideration of the acoustic transducer according to the present invention yields the following relationship:

$$V = \frac{k^{2/3}\sqrt{3h_i}}{N^{2/3}w_c^{2/3}E^{1/6}\sqrt{\varepsilon_r\varepsilon_0 h_c}}w_d^{2/3}(\delta_0 - w_d)^{1/3} \quad (1)$$

In which, V is the applied electrical potential, k is the stiffness of diaphragm 101 when loaded by a force in the center, $h_i$ is the thickness of insulator layer 107, N is the number of cantilevers 102, $w_c$ is the width of cantilevers 102, E is the combined Young's modulus of the cantilever materials, $h_c$ is the thickness of cantilevers 102, $\epsilon_r$ is the relative permittivity of insulator layer 107, $\epsilon_0$ is the permittivity of vacuum, $w_d$ is the center deflection of diaphragm 101 per FIG. 5, and $\delta_0$ is the depth of cavity 106 per FIG. 5. With this equation, it is possible to establish the diaphragm deflection versus applied electrical potential of the acoustic transducer. To illustrate the function of the acoustic transducer, an example device was analyzed with the following parameters:

| | |
|---|---|
| k | 26.8 N/m |
| $E_c$ | 160 GPa |
| N | 8 |
| $h_c$ | 2 μm |

-continued

| | |
|---|---|
| $w_c$ | 150 μm |
| $\epsilon_r$ | 8 |
| l | 2 mm |
| $\delta_0$ | 40 μm |

These are dimensions and characteristics that are readily implemented using micro fabrication technology. The diaphragm deflection $w_d$ can be calculated from (1) and is shown as function of the applied electrical potential in FIG. 6. The diaphragm stiffness factor k selected in this example is consistent with a 1 μm thick silicon nitride diaphragm and a diameter of 6 mm.

Figure 6:
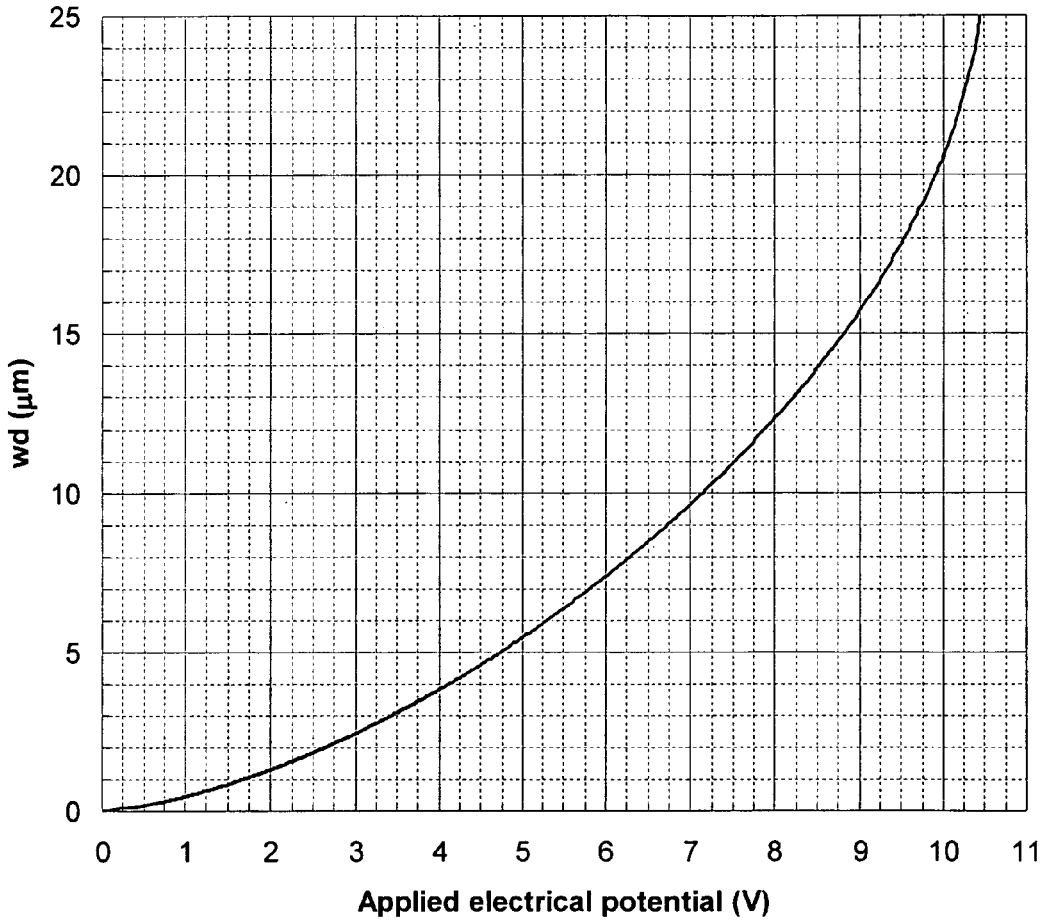
FIG. 6 is a graph depicting the relationship between diaphragm center deflection, defined in FIG. 5, and applied electric potential for an example electrostatic acoustic transducer according to the present invention.

If an electrical operating potential of 8 V is selected, according to FIG. 6 the diaphragm will have a static deflection of ~12.4 μm. If the electrical potential is now varied, the diaphragm deflection will track the curve shown in FIG. 6. In order to generate for instance 108 dB SPL sound pressure in a 2 cc closed volume, the average deflection of the example diaphragm must be 3.44 μm. The volumetric deflection factor for the example diaphragm is 0.286. From this it can concluded the center deflection $w_d$ of the diaphragm must be:

$$w_d = \frac{3.44\ \mu\text{m}}{0.286} = 12.0\ \mu\text{m} \quad (2)$$

From FIG. 6, it is evident that such a displacement can be generated with ~2.4 V positive amplitude, or ~7 V negative amplitude, from the electrical operating potential of 8 V.

While a specific embodiment has been illustrated and described, many variations and modifications in structure and materials may be apparent to those skilled in the art. Such variations shall also be claimed assuming they fall within the scope of the present invention.

What is claimed is:

1. An electrostatic acoustic transducer comprising a diaphragm formed on a first substrate;

one or more electrically conductive cantilevers attached to the center section of said diaphragm, the other end of said cantilevers being free to move;

means for providing an air gap between said cantilevers and diaphragm;

an electrically conductive counter electrode formed on a second substrate;

means for attaching said second substrate to said first substrate;

an electrically insulating layer on said counter electrode or said cantilevers, positioned to prevent electrical connection between said cantilevers and counter electrode in case said cantilevers and counter electrode are in mechanical contact;

a cavity formed in said counter electrode to realize an initial gap between said cantilevers and counter electrode;

one or more venting holes formed in said second substrate in areas that overlay said diaphragm to allow air to flow to and from said cavity;

means for providing electrical connection to apply and vary an electric potential between said counter electrode and cantilevers causing an electrostatic attraction force between cantilevers and counter electrode, causing said cantilevers to collapse on to said counter electrode, causing a transfer of force to said diaphragm, thereby creating a deflection of said diaphragm; and means for the reduction of stiction between said cantilevers and counter electrode when in mechanical contact, thereby allowing the diaphragm and cantilever restoring forces to separate said cantilevers from the counter electrode when the applied electrical potential is reduced or removed.

2. The acoustic transducer according to claim 1, in which said diaphragm is formed by micro fabrication on the first substrate.

3. The acoustic transducer according to claim 1, in which said diaphragm is made from one or more materials from the list consisting of silicon, polycrystalline silicon, silicon dioxide, silicon nitride, and polymer.

4. The acoustic transducer according to claim 1, in which said first substrate is made of silicon.

5. The acoustic transducer according to claim 1, in which said cantilevers are made of a single layer of electrically conducting material.

6. The acoustic transducer according to claim 1, in which said cantilevers are made of a multiple layers of electrical conductive materials and insulators.

7. The acoustic transducer according to claim 1, in which said means for providing an air gap between the cantilevers and diaphragm involves the deposition and subsequent removal of a temporary sacrificial layer.

8. The acoustic transducer according to claim 1, in which said counter electrode is a conductive material deposited on the second substrate.

9. The acoustic transducer according to claim 1, in which said second substrate is conductive or semi-conductive.

10. The acoustic transducer according to claim 9, in which said second substrate forms said counter electrode.

11. The acoustic transducer according to claim 10, in which said second substrate is made from one or more materials from the list consisting of silicon, nickel, aluminum, stainless steel, and titanium.

12. The acoustic transducer according to claim 1, in which said insulating layer is deposited on the second substrate.

13. The acoustic transducer according to claim 12, in which said insulating layer is made of silicon dioxide, silicon nitride, or a polymer.

14. The acoustic transducer according to claim 1, in which said insulating layer is formed on the cantilevers.

15. The acoustic transducer according to claim 14, in which said insulating layer is made of silicon dioxide, silicon nitride, or a polymer.

16. The acoustic transducer according to claim 1, in which said cavity is formed by etching into the second substrate.

17. The acoustic transducer according to claim 1, in which said venting holes are formed by etching in the second substrate.

18. The acoustic transducer according to claim 1, in which said holes are formed by stamp cutting in the second substrate.

19. The acoustic transducer according to claim 1, in which said means for attaching the second substrate to the first substrate is a bonding method.

20. The acoustic transducer according to claim 19, in which said bonding method is anodic bonding, adhesive bonding, direct bonding, thermo-compression bonding, eutectic bonding, thermo-sonic bonding, microwave bonding, or solder bonding.

21. The acoustic transducer according to claim 1, in which said means for stiction reduction involves the deposition of an anti-stiction coating layer on the cantilevers and the counter electrode.

22. The acoustic transducer according to claim 21, in which said anti-stiction coating is deposited in liquid phase.

23. The acoustic transducer according to claim 21, in which said anti-stiction coating is deposited in vapor phase.

24. The acoustic transducer according to claim 1, in which the transducer is a sound generating speaker.

25. The acoustic transducer according to claim 1, in which the transducer is a sound detecting microphone.

26. The acoustic transducer according to claim 1, in which said cavity is formed by compression stamping of the second substrate.

* * * * *